US007588125B2

(12) United States Patent
Ueda et al.

(10) Patent No.: US 7,588,125 B2
(45) Date of Patent: Sep. 15, 2009

(54) ELEVATOR CONTROL DEVICE

(75) Inventors: Takaharu Ueda, Tokyo (JP); Masaya Sakai, Tokyo (JP); Masunori Shibata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 386 days.

(21) Appl. No.: 11/573,699

(22) PCT Filed: Nov. 14, 2005

(86) PCT No.: PCT/JP2005/020828

§ 371 (c)(1),
(2), (4) Date: Feb. 14, 2007

(87) PCT Pub. No.: WO2007/055023

PCT Pub. Date: May 18, 2007

(65) Prior Publication Data

US 2008/0315802 A1 Dec. 25, 2008

(51) Int. Cl.
*B66B 1/28* (2006.01)

(52) U.S. Cl. ..... 187/293; 318/802; 318/805

(58) Field of Classification Search ..... 187/247, 187/281, 284, 289–293, 296, 297, 248, 277; 318/798–815

See application file for complete search history.

(56) References Cited

U.S. PATENT DOCUMENTS 4,625,834 A * 12/1986 Tanahashi ..... 187/296
4,779,708 A * 10/1988 Sasao et al. ..... 187/296
4,870,334 A * 9/1989 Iwasa et al. ..... 318/432
5,060,764 A * 10/1991 Ohira ..... 187/293
5,270,498 A * 12/1993 Tanahashi ..... 187/293
2005/0162143 A1 7/2005 Fukumoto et al.
2007/0284196 A1* 12/2007 Sakai et al. ..... 187/305

FOREIGN PATENT DOCUMENTS

CN 85101333 A 9/1986

(Continued)

OTHER PUBLICATIONS

U.S. Appl. No. 11/794,823, filed Jul. 6, 2007, Ueda et al.

*Primary Examiner*—Jonathan Salata
(74) *Attorney, Agent, or Firm*—Oblon, Spivak, McClelland, Maier & Neustadt, P.C.

(57) ABSTRACT

An elevator control device that drives a cage in a high-efficient speed pattern without using a load detector such as a conventional scale device. The elevator control device includes: a current detector for detecting a current that is supplied to a motor from an inverter; a speed detector for detecting a rotation speed of the motor; a speed pattern generator for generating an elevator speed pattern; a motor speed control device for controlling the speed so that a speed detection value follows a speed command value of the speed pattern; and a motor current control device for controlling a current that is supplied to the motor with respect to the inverter by using a current detection value and the speed detection value on the basis of the speed command value. The motor current control device has a duty detector for detecting a duty that is a ratio of an on-time of the inverter within a given sampling period, and the speed pattern generator changes the speed pattern of the motor based on a duty detection value detected by the duty detector.

7 Claims, 9 Drawing Sheets

FOREIGN PATENT DOCUMENTS

| | | | |
|---|---|---|---|
| CN | 1176933 | A | 3/1998 |
| CN | 1613173 | | 5/2005 |
| EP | 1 471 625 | A1 | 10/2004 |
| GB | 2 310 770 | A | 9/1997 |
| JP | 9-67071 | | 3/1997 |
| JP | 9-233898 | | 9/1997 |
| JP | 11-299290 | | 10/1999 |
| JP | 2005-280933 | | 10/2005 |
| WO | 03 050028 | | 6/2003 |
| WO | WO 03/058799 | A1 | 7/2003 |

* cited by examiner

ELEVATOR CONTROL DEVICE

TECHNICAL FIELD

The present invention relates to an elevator control device which makes a travel speed of a cage variable.

BACKGROUND ART

Up to now, there has been developed an elevator control device that changes a speed pattern which is given to a motor according to a cage load capacity to adjust an acceleration/deceleration speed and a maximum speed. The elevator control device of this type includes a control device that controls a cage travel according to a speed which is predetermined in correspondence with a cage load capacity which is detected by a scale device or the like, or a speed that is calculated on the basis of the cage load capacity, or a control device that detects a load that is exerted on a motor according to a current which flows in the motor during travel to adjust a speed. For example, there is an elevator control device that includes means for detecting a load capacity of a cage, and changes the speed pattern according to the cage load capacity and the travel distance to adjust the acceleration or deceleration speed and the maximum speed (For example, refer to Patent Document 1).

Patent Document 1: JP 2003-238037 A

DISCLOSURE OF THE INVENTION

Problems to be Solved by the Invention

However, the elevator control device that detects the cage load capacity by a scale device or the like to change the speed pattern suffers from such a problem that a load of a driver device such as a motor or an inverter becomes large in the case where a detection error of the scale device or a travel loss is large.

Also, when the speed pattern is calculated in anticipation of the error in the scale device or the loss, there arises such a problem that the control becomes conservative in the case where the error or the loss is small, and the cage travels at a speed that is lower than a speed that can be originally exercised with the result that the performance of the driver device cannot be sufficiently exercised.

The present invention has been made to solve the above-mentioned problems, and therefore an object of the present invention is to provide an elevator control device that drives the cage in a high-efficient speed pattern without using lad detecting means such as the conventional scale device.

Means of Solving the Problems

The present invention provides an elevator control device which causes a cage to be raised and lowered by a motor driven by an inverter the cage being connected to one end of a rope having the other end connected to a counterweight through a sheave, the elevator control device including: a current detector for detecting a current that is supplied to the motor from the inverter; a speed detector for detecting the rotation speed of the motor; speed pattern generating means for generating an elevator speed pattern; a motor speed control device for controlling a speed so that a speed detection value from the speed detector follows a speed command value of the speed pattern from the speed pattern generating means; and a motor current control device for controlling a current that is supplied to the motor with respect to the inverter by using a current detection value from the current detector and the speed detection value from the speed detector on the basis of the speed command value from the motor speed control device, in which: the motor current control device has duty detecting means for detecting a duty that is a ratio of an on-time of the inverter within a given sampling period and the speed pattern generating means changes the speed pattern of the rotor on the basis of a duty detection value that is detected by the duty detecting means.

The elevator control device further includes voltage calculating means for calculating a voltage that is applied to the motor on the basis of a current detection value from the current detecting means and a speed detection value fro the speed detecting means, and the speed pattern generating means changes the speed pattern of the motor on the basis of the output of the voltage calculating means.

Further, the speed pattern generating r means changes over the speed pattern to a constant speed travel in a case where a difference between the speed detection value from the speed detector and a speed pattern or a differential value of the difference exceeds a threshold value that is set in advance during acceleration of the cage.

Further, the motor current control means outputs a control command to the speed pattern generating means so as to stop the acceleration and change over the speed pattern to a constant speed travel in the case where a difference between a current detection value from the current detector and a current command value or a differential value of the difference exceeds a threshold value that is set in advance during the acceleration of the cage, and he speed pattern generating means changes over the speed pattern to the constant speed travel on the basis of the control command from the motor current control device.

EFFECTS OF THE INVENTION

The present invention provides elevator drive control which detects a voltage saturation that is developed by a drive torque and a speed of the motor in advance, changes a speed pattern of the motor, prevents the voltage saturation of the motor, and is higher in the speed and more stable than those in the conventional art, thereby making it possible to drive the cage in a high-efficient speed pattern without using the load detecting means such as the scale device in the conventional art.

BEST MODE FOR CARRYING OUT THE INVENTION

First Embodiment

Figure 1:
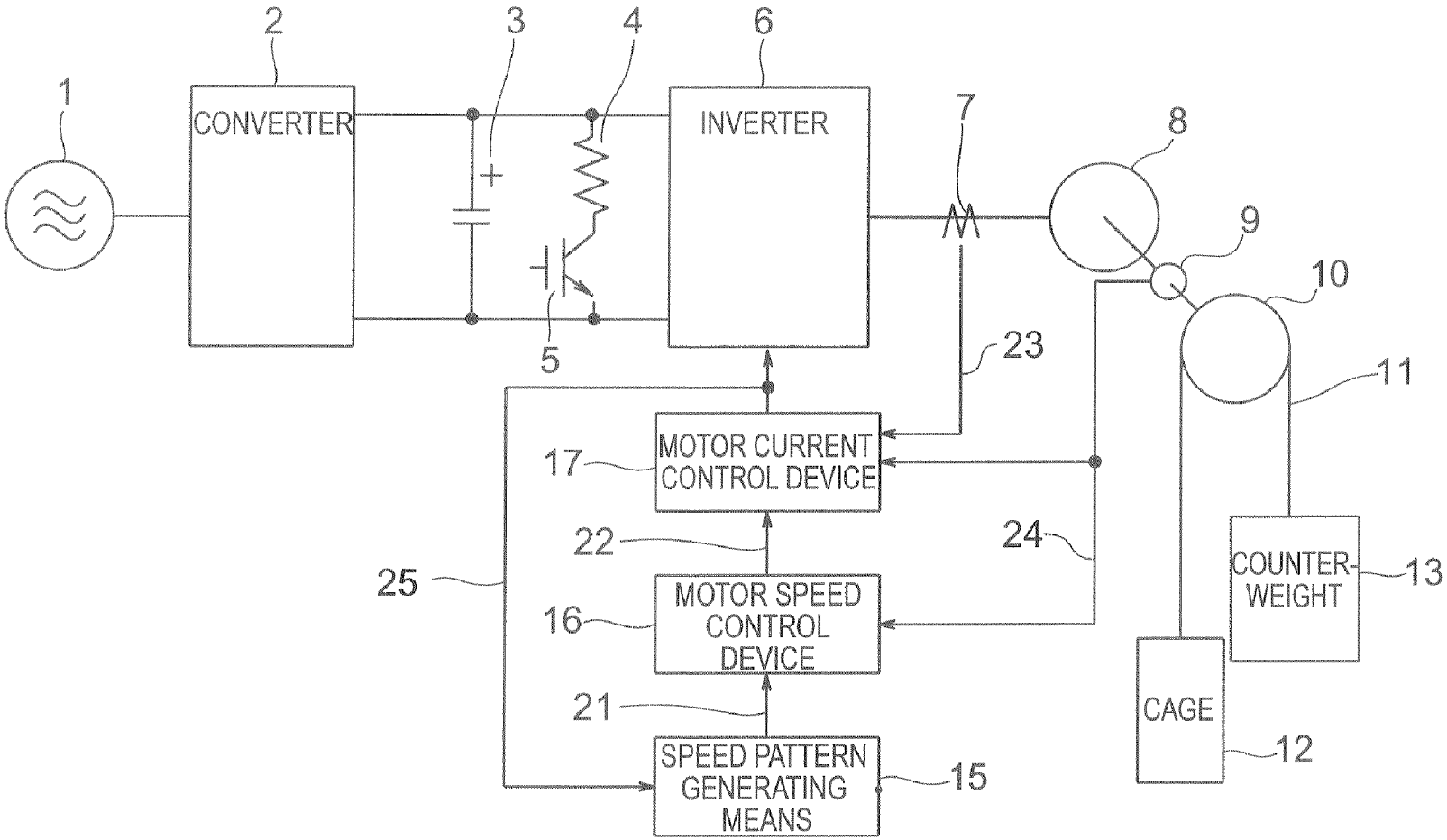
FIG. 1 is a block diagram showing the configuration of an elevator control device according to a first embodiment of the present invention.

FIG. 1 is a block diagram showing the configuration of an elevator control device according to a first embodiment of he present invention. The elevator control device shown in FIG. 1 includes a converter 2 that converts AC from an A power supply 1 to DC, a smoothing capacitor 3 that smoothes the DC output from the converter 2, a series connection member composed of a regeneration resistor 4 and a regeneration switch 5 which are connected in parallel with the smoothing capacitor 3, and an inverter 6 that converts the DC output of the converter 2 which has been smoothed by the smoothing capacitor 3 into AC and supplies the AC converted output to a motor 8. The elevator control device drives the motor 8, and raises and lowers a cage 12 which is coupled to one end of a rope 11 having the other end connected to a counterweight 13 through a sheave 10.

Also, the elevator control device shown in FIG. 1 includes a current detector 7 that detects a current which is supplied to the motor 8 from the inverter 6, a speed detector 9 that detects the rotation speed of the motor 8, speed pattern generating means 15 for arithmetically generating a speed pattern 21 of the elevator a motor speed control device 16 that outputs a speed command value 22 so as to control the speed so that a speed detection value 24 from the speed detector 9 follows the speed pattern of the speed pattern generating means 15 and a motor current control device 17 that outputs a current command value 25 as a drive signal of the inverter 6 to control a current which is supplied to the motor 8 with respect to the inverter 6 by using a current detection value 23 from the current detector 7 and the speed detection value 24 from the speed detector 9 on the basis of the speed command value 22 from the motor speed control device 16.

In this example, the motor current control device 17 includes duty detecting means for detecting a duty which is a ratio of the on-time of the inverter 6 in a given sampling period, and the speed pattern generating means 15 changes the speed pattern of the motor on the basis of the duty detection value 25 which is detected by the duty detecting means.

Subsequently, the operation of the elevator control device configured as described above will be described.

The cage 12 and the counterweight 13 are coupled to both ends of the rope 11 through the sheave 10, and the sheave 10 is rotated by the motor 8 to raise and lower the cage 12. The motor 8 is driven by the inverter 6.

Also, the inverter 6 is generally controlled in the current by the current control device 17 of the motor 8. At this time, vector control is frequently used for the current control conducted by the current control device 17, and the current control is conducted by using the speed and the magnetic pole position of the motor which are detected by the speed detector 9, and the motor current that is detected by the current detector 7. The current control device 17 instructs the switching pattern of on/off to a transistor that is equipped in the inverter 6 according to a current necessary for the motor 8.

The motor speed control device 16 that controls the speed of the motor is disposed upstream of the motor current control device 17, and conducts the speed control so that the speed of the motor which is detected by the speed detector 9 follows the speed command value that is generated by the speed pattern generating means 15.

The AC from the AC power supply 1 is converted into DC by the converter 2, and the DC voltage smoothed by the smoothing capacitor 3 becomes an input of the inverter 6. Also, the smoothing capacitor 3 is connected in parallel with a series connection member composed of the regeneration switch 5 and the regeneration resistor 4.

The regeneration resistor 4 is disposed for the purpose of consuming the power regenerated when the motor 3 is regeneratively driven as heat. This is conducted by turning on the regeneration switch 5 when the voltage across the smoothing capacitor 3 exceeds a given reference value to provide a closed circuit composed of the smoothing capacitor 3 and the regeneration resistor 4, and allowing the current to flow in the regeneration resistor 4. When the regeneration switch 5 is on, a current flows in the regeneration resistor 4, and the voltage across the smoothing capacitor 3 decreases. Then, when the voltage across the smoothing capacitor 3 is lower than a given value, the regeneration switch 5 turns off to stop the energization of the regeneration resistor 4, and a decrease in the voltage across the smoothing capacitor 3 stops.

As described above, the regeneration switch 5 turns on or off according to the voltage across the smoothing capacitor 3 whereby the DC input voltage to the inverter 6 is controlled within a predetermined range. A semiconductor switch is generally used for the regeneration switch 5.

Figure 2:
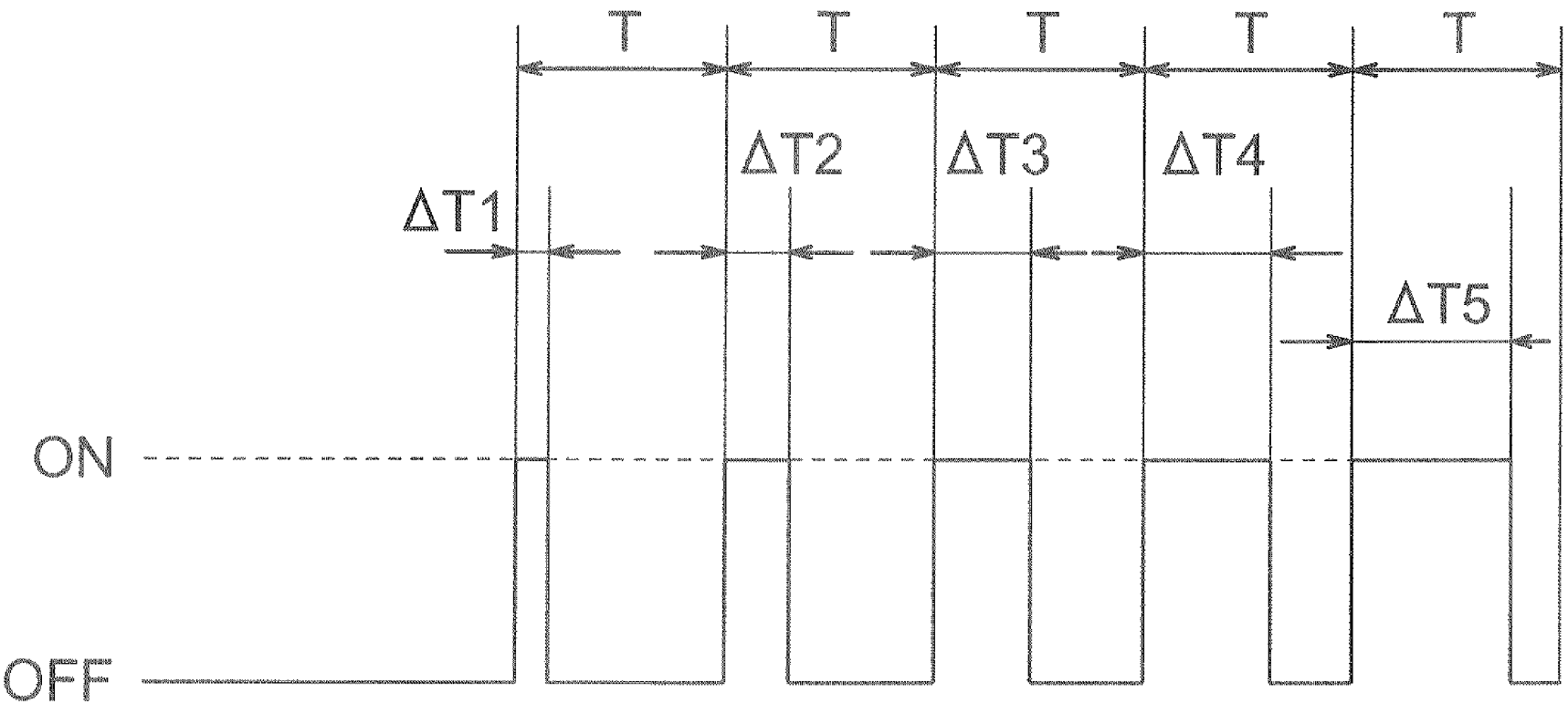
FIG. 2 is a diagram for explaining a duty of an inverter according to the first embodiment of the present invention.

FIG. 2 shows a duty ratio Ti of a command to the inverter 6 which changes as the cage 12 starts to travel in a power running state (for example, in the case where the cage 12 is raised in the filled capacity) and the speed increases in this example, the duty ratio T1 is a time ratio of the on-state of the command to the inverter 6 within a given sampling period T and for example, can be calculated by $\Delta Ti/T$. FIG. 2 shows a state in which the ratio of the on-time increases according to an increase in the speed of the cage 12. The duty is multiplied by the detection output of a bus voltage, thereby making it possible to calculate a voltage that is applied to the motor 8. The voltage saturation that is developed by the drive torque and speed of the motor 8 is detected in advance according to the calculated voltage, or the voltage saturation is detected in advance according to the duty when the bus voltage hardly varies, and the speed pattern of the motor 8 is changed by the speed pattern generating means 15.

Figure 3:
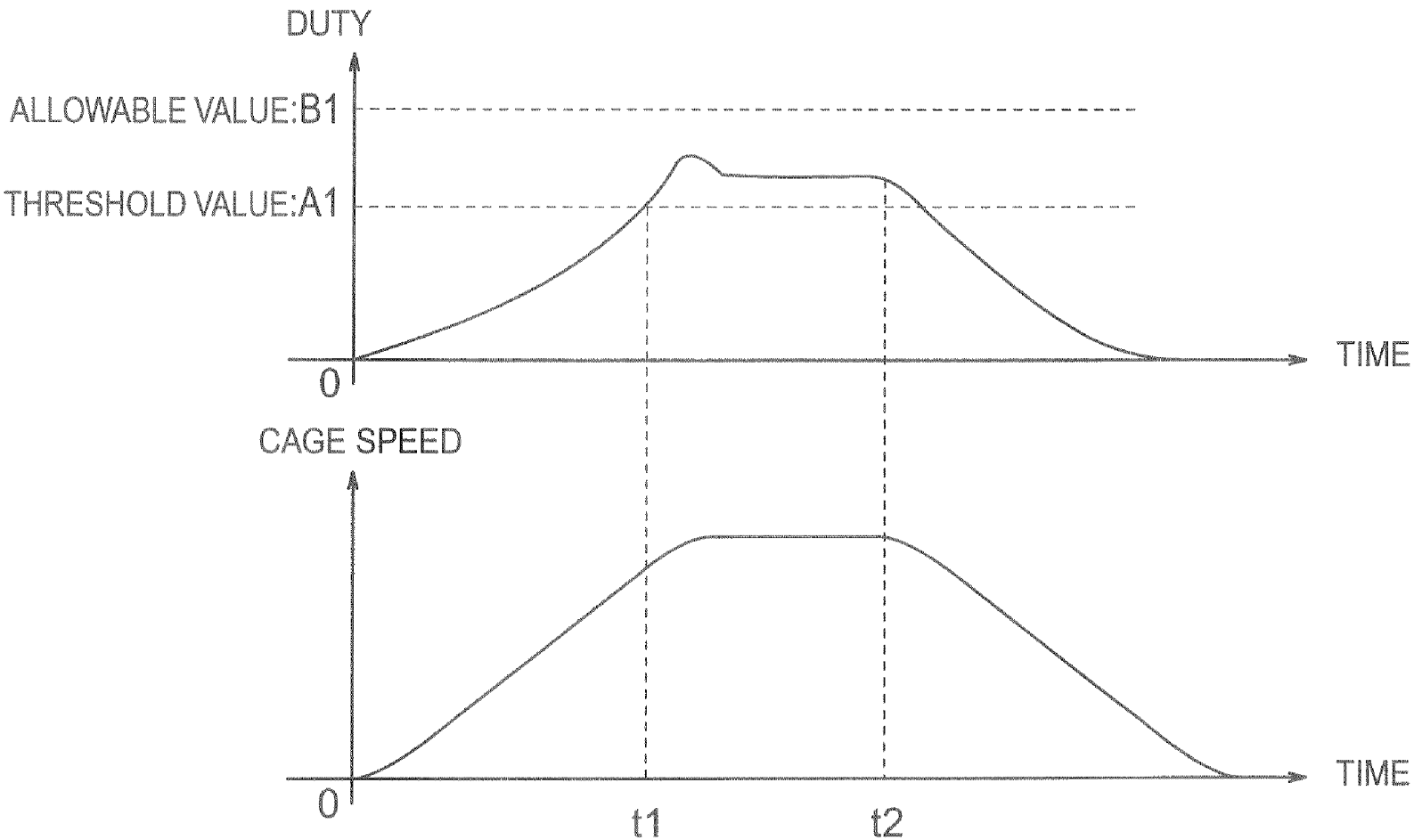
FIG. 3 is a diagram for explaining speed pattern generation according o the first embodiment of the present invention.

In other words, FIG. 3 is a diagram for explaining the speed pattern generation due to the speed pattern generating means 15 in this example a threshold value A1 of the duty is set on the basis of an allowable value B1 where the inverter 6 is not an overload, and is set so as not to exceed the allowable value B1 taking a duty that increases between an acceleration round start time t1 and a constant speed running at which the acceleration state changes over to the constant speed state, and a duty that temporarily increases from a deceleration start time t2 into consideration.

As shown in FIG. 3, when the duty of the on-time of the inverter 6 reaches a threshold value A1 at a time t1 while the cage 12 is traveling in an acceleration state according to the speed pattern of the cage speed, the speed pattern generating means 15 stops acceleration, calculates the speed pattern in which the cage 12 travels at the constant speed, and outputs the speed pattern to the motor speed control device 16. Because the motor speed control device 16 controls the motor 8 according to the speed pattern, the cage travels at the constant speed. When the acceleration speed changes over to the constant speed, the speed pattern changes over from the acceleration state to the constant speed pattern with a smooth curve, taking the ride quality of passengers within the cage 12 into consideration. Then, when the cage 12 arrives at a deceleration start point of a time t2, the speed pattern generating means 15 generates the speed pattern that permits the deceleration and the cage 12 is decelerated and stops.

The duty that increases from the acceleration round start until the constant speed travel depends on the acceleration and the acceleration round pattern when the acceleration changes over to the constant speed. An increase in the duty becomes larger as the acceleration is larger and the acceleration round time is larger. Also, the duty that temporarily increases at the time of starting the deceleration depends on the deceleration round pattern when the deceleration speed or the constant speed changes to the deceleration, and an increment of the duty becomes larger as the deceleration is larger and the deceleration round time is smaller.

The threshold value A1 can be set so that the duty does not exceed an allowable value B1 according to the acceleration or the acceleration round pattern, or the acceleration or the acceleration round pattern can be set so that the duty does not exceed the allowable value B1 according to the threshold value A1.

Also, the threshold value A1 can be set so that the duty does not exceed the allowable value B1 after the deceleration and the deceleration round pattern are set, or the deceleration and the deceleration round pattern can be set so that the duty does not exceed the allowable value B1 after the threshold value A1 is set. Then, the threshold value A1 can be reset for each of travels. In addition the threshold value can be changed over between the power running and the regeneration of the motor 8. For example, when a heat margin is provided in the regeneration resistor 4, the regeneration operation can take the maximum speed and the drive torque which are larger than those in the power running operation, thereby making it possible to generate a high speed pattern.

Also, the high-speed operation becomes more possible as the threshold value A1 is larger. However, the deceleration cannot be made larger as the threshold value A1 is larger, thereby making it necessary to extend the deceleration round time. Hence, the tradeoff relationship exists among the threshold value A1, the deceleration, and the deceleration round pattern in a case of shortening the operation time. Therefore, it is preferable to set the threshold value A1, the deceleration, and the deceleration round pattern so as to shorten the travel time.

In the conventional example, there is provided means for detecting the cage load capacity, and the speed pattern is calculated according to the cage load capacity that is detected by the detecting means. In this situation, it is necessary to calculate the speed pattern in expectation of the design margin with respect to the detection error of the cage load capacity. However, in the present invention, because the means for detecting the cage load capacity is not required, it is unnecessary to provide the design margin with respect to the load capacity for the purpose of calculating the speed pattern, so even if there is an error in the detection of the cage load capacity, it is possible to travel the cage at the maximum speed within a range permissible by the motor.

Therefore, according to the first embodiment, there can be provided the elevator drive control that calculates a voltage that is applied to the motor 8 according to the duty of the inverter 6, detects the voltage saturation that is developed by the drive torque and speed of the motor 8 in advance changes the speed pattern to the motor 8, prevents the voltage saturation of the motor 8, and is higher in the speed and more stable than those in the conventional art. The cage operation can be performed by a high-efficient speed pattern without using load detecting means such as the conventional scale device.

Second Embodiment

Figure 4:
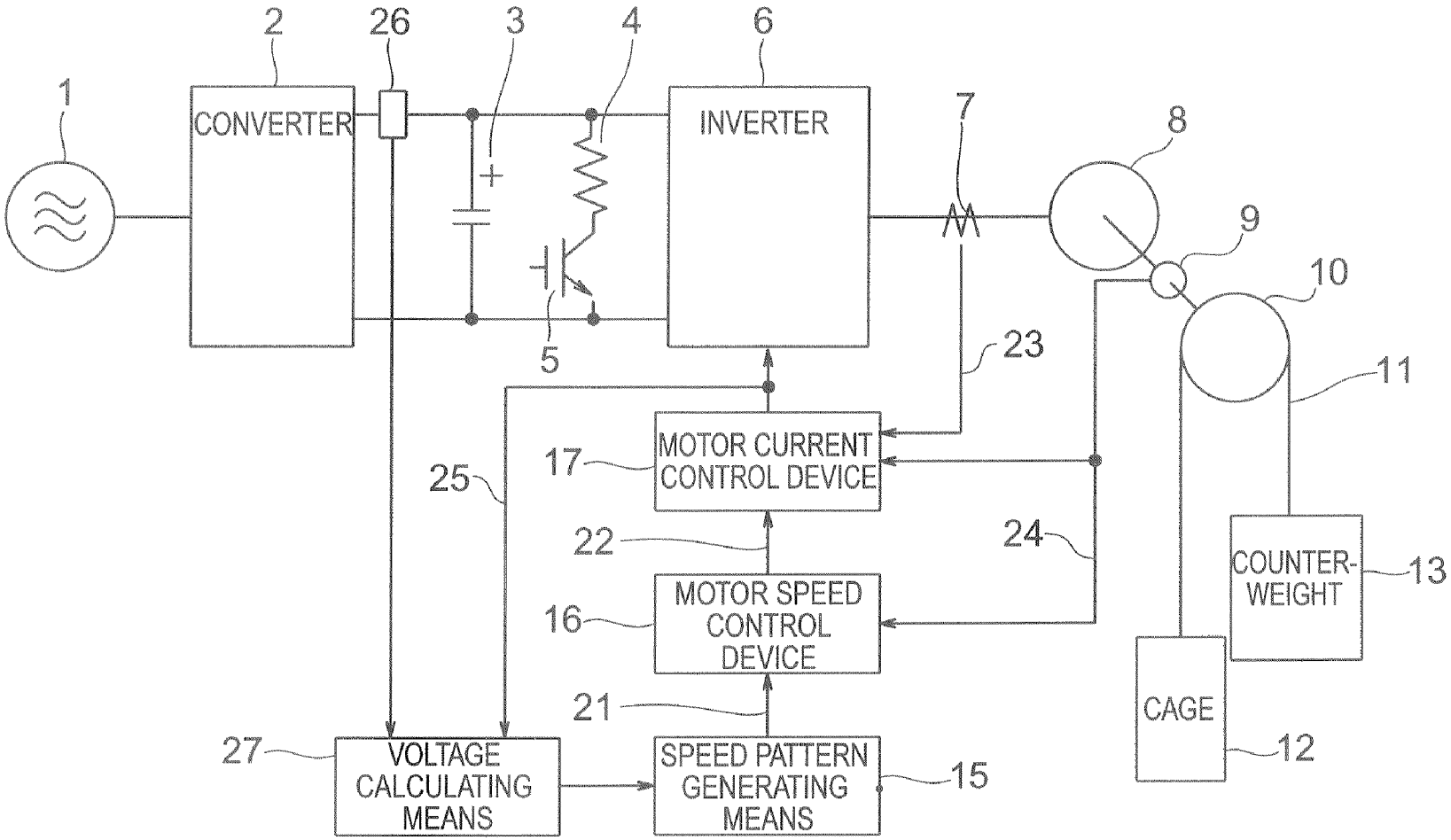
FIG. 4 is a block diagram showing the configuration of an elevator control device according to a second embodiment of the present invention.

FIG. 4 is a block diagram showing the configuration of an elevator control device according to a second embodiment of the present invention. In the configuration of the second embodiment shown in FIG. 4, the same parts as those in the first embodiment shown in FIG. 1 are designated by like symbols, and their description will be omitted. In FIG. 4, the elevator control device further includes bus voltage measuring means 26 for measuring a DC voltage that has been smoothed by the smoothing capacitor 3 and voltage calculating means 27 for calculating the voltage that is applied to the motor 8 according to the output signal of the bus voltage detecting means 26 and the duty in addition to the configuration of the first embodiment shown in FIG. 1. The speed pattern generating means 15 changes the speed pattern of the motor 8 on the basis of the output of the voltage calculating means 27.

In other words, the output of the voltage calculating means 27 is com pared with the threshold value shown in FIG. 3 by the speed pattern generating means 15, to thereby obtain the same effects as those in the first embodiment. Since motor supply voltage can be obtained with high precision even in the case where the bus voltage varies due to the voltage variation of the AC power supply 1 it is possible to generate the speed pattern with higher precision.

Therefore, according to the second embodiment, a voltage that is applied to the motor 8 is calculated according to the bus voltage and duty of the inverter 6, the voltage saturation that is developed by the drive torque and speed of the motor 8 is detected in advance, the speed pattern to the motor 8 is changed so as to prevent the voltage saturation of the motor 8, and the bus voltage is detected to improve a precision in the voltage calculation due to the variation of the AC power supply 1. As a result, there can be provided the elevator drive control that is higher in the speed and stable.

Third Embodiment

Figure 5:
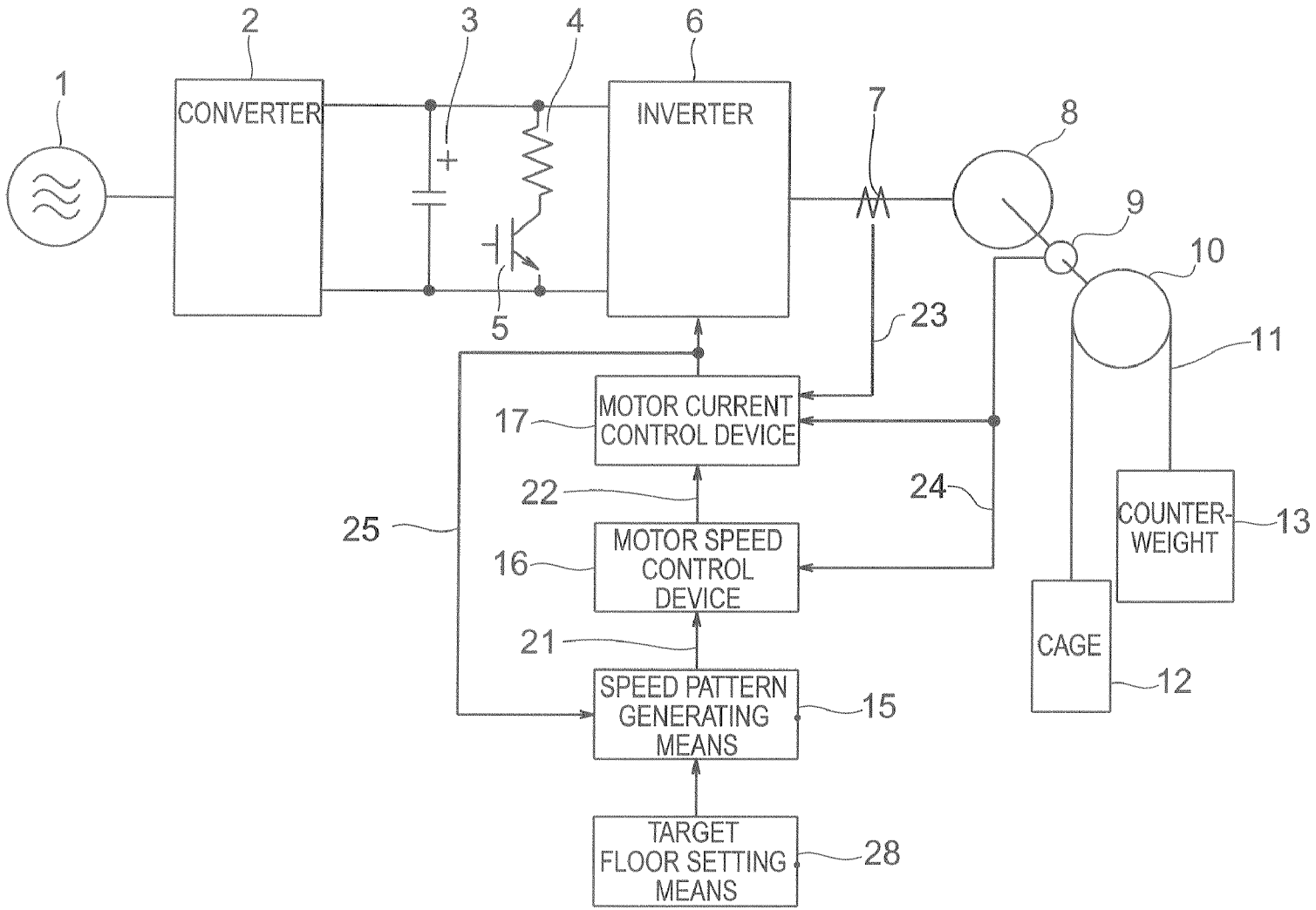
FIG. 5 is a block diagram showing the configuration of an elevator control device according to a third embodiment of the present invention.

FIG. 5 is a block diagram showing the configuration of an elevator control device according to a third embodiment of the present invention. In the configuration of the third embodiment shown in FIG. 5, the same parts as those in the first embodiment shown in FIG. 1 are designated by like symbols and their description will be omitted. In FIG. 5, the elevator control device further includes target floor setting means 28 for generating an instruction to move the elevator from a present floor to a target floor upstream of the speed pattern generating means 15 in addition to the configuration of the first embodiment shown in FIG. 1. The speed pattern generating means 15 changes the magnitude of the acceleration of the speed pattern that is generated according to the movement distance to the target floor which is set according to the target floor setting means 28.

Figure 6:
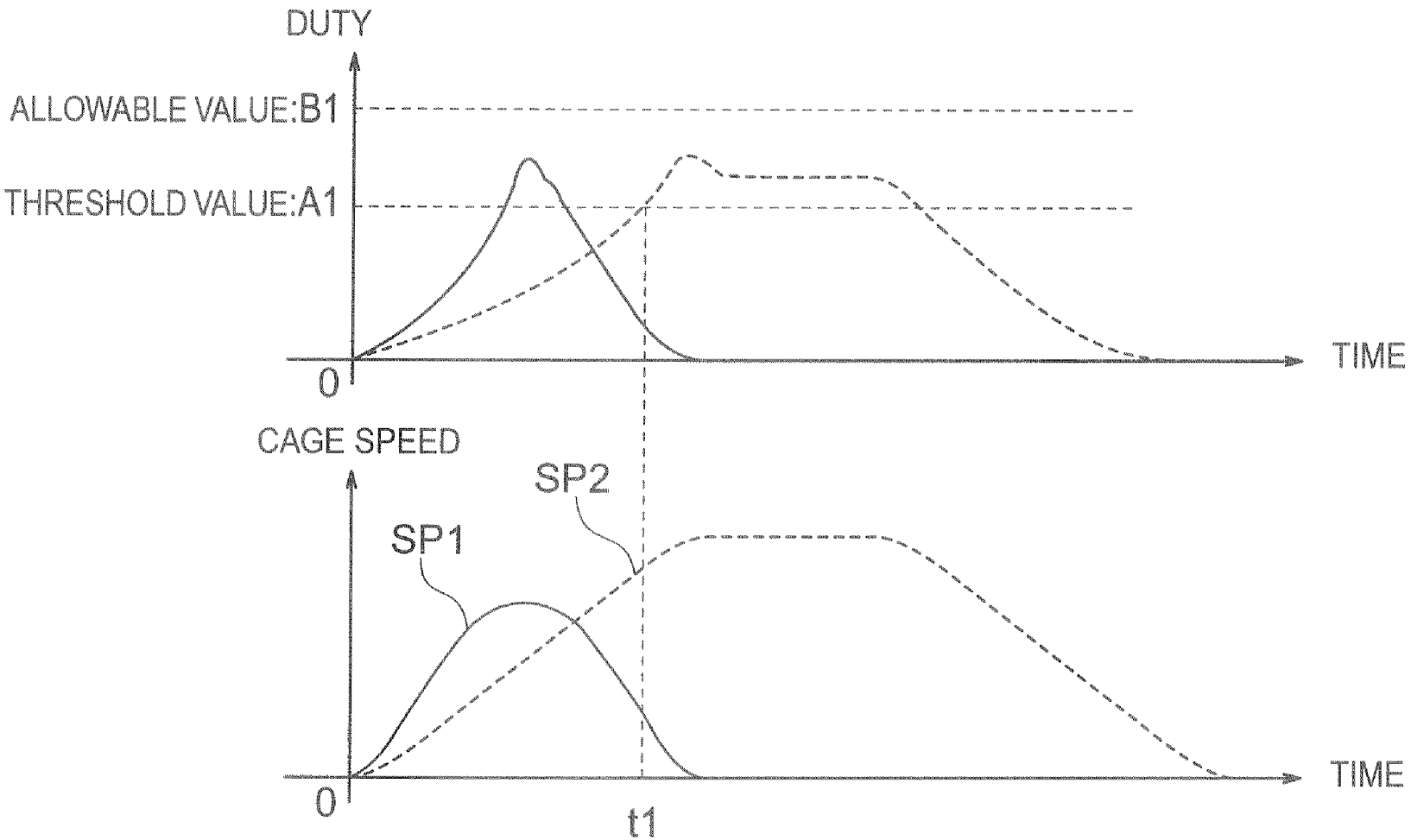
FIG. 6 is a diagram showing an example of a speed pattern of an elevator according to the third embodiment of the present invention.

In other words, the target floor setting means 28 operates to select a high acceleration pattern SP1 shown in FIG. 6, for example, in a short distance movement where a distance speed constant pattern cannot be produced, and a low acceleration pattern SP2 in a long distance movement other than the short distance movement, as shown in FIG. 6. With the operation, there can be provided an elevator control device that enables the cage to arrive at the target floor in the shortest period of time.

Therefore, according to the third embodiment, there can be provided the elevator control device that enables the cage to arrive at the target floor in the shortest period of time by setting the acceleration to be higher in a driven movement distance or shorter in a state where the motor 8 does not reach the maximum speed that can be generated, and setting the acceleration to be lower than the set value in a movement distance other than the above-mentioned movement distance, according to the movement distance due to the output of the target floor setting means 28.

Fourth Embodiment

Figure 7:
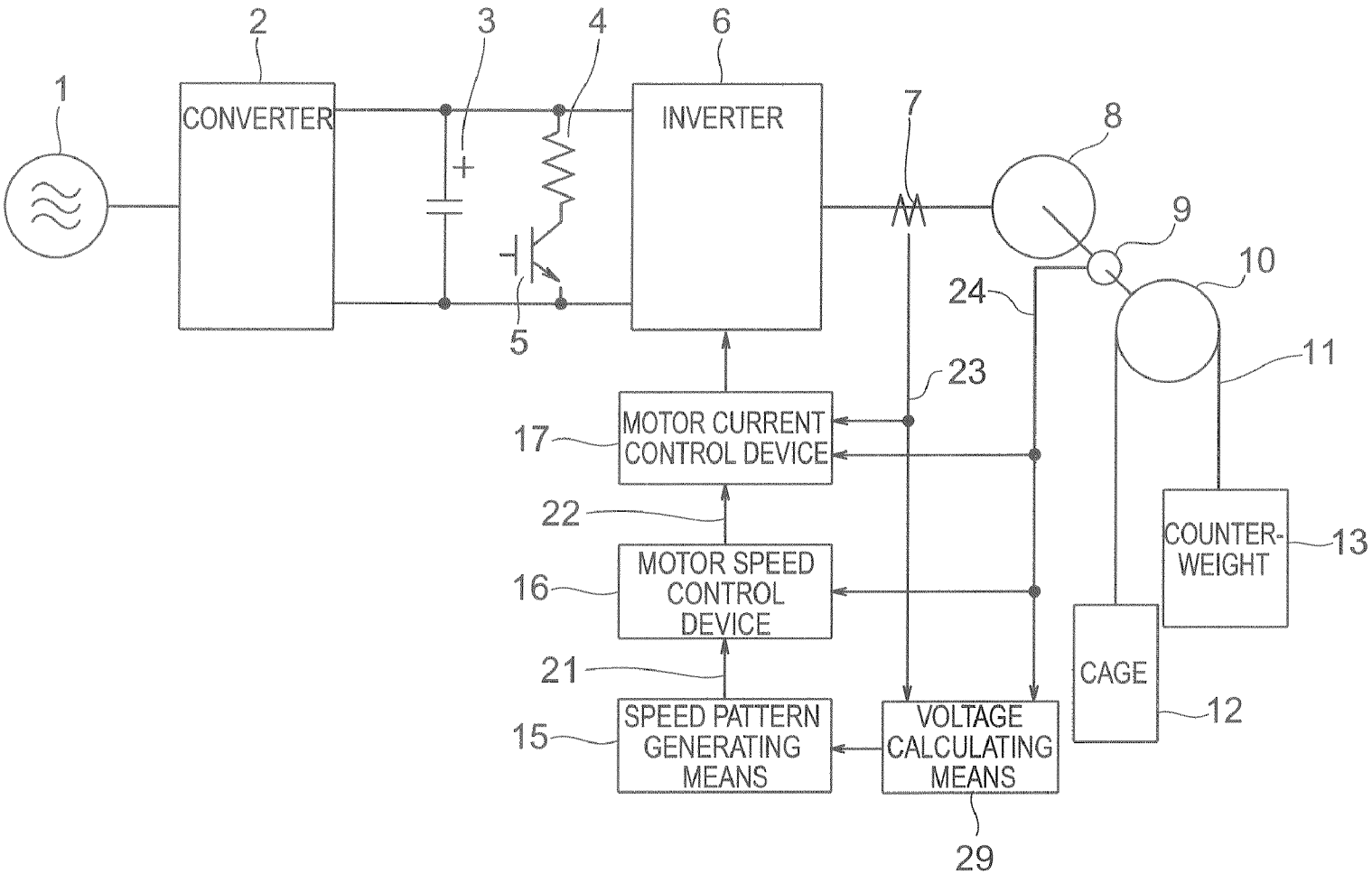
FIG. 7 is a block diagram showing the configuration of an elevator control device according to a fourth embodiment of the present invention.

FIG. 7 is a block diagram showing the configuration of an elevator control device according to a fourth embodiment of the present invention. In the configuration of the fourth embodiment shown in FIG. 7, the same parts as those in the first embodiment shown in FIG. 1 are designated by like symbols, and their description will be omitted. In FIG. 7, the elevator control device further includes voltage calculating means 29 that calculates a voltage that is applied to the motor 8 on the basis of the current detection value from the current detector 7 and the speed detection value from the speed detector 9 in addition to the configuration of the first embodiment shown in FIG. 1. The speed pattern generating means 15 changes the speed pattern of the motor 8 on the basis of the output of the voltage calculating means 29.

In other words, the voltage calculating means 29 operates to calculate the voltage that is applied to the motor 8 according to the output signals of the current detector 7 and the speed detector 9, and the speed pattern generating means 15 compares the output signal of the voltage calculating means 29 with the threshold value shown in FIG. 3 so as to obtain the same effects as those in the first embodiment, and there are advantages that the speed pattern can be generated with higher precision by the simple configuration.

While in the fourth embodiment the speed pattern is switchingly generated according to the voltage of the motor 8, the speed pattern may be switchingly generated according the motor current, the regenerative power, and the motor power to obtain the same effects.

Therefore, according to the fourth embodiment, the voltage that is applied to the motor 3 is calculated according to the current that flows in the motor 8 and the rotation speed, the voltage saturation of the motor which is developed by the drive torque and speed of the motor 3 is detected in advance, the speed pattern to the motor 8 is changed so as to prevent the voltage saturation of the motor 8, and the voltage calculation is implemented by the current detector 7 and the speed detector 9 which are installed within the control device. As a result, there can be provided the elevator drive control that is higher in the speed and stable without increasing costs.

Fifth Embodiment

Figure 8:
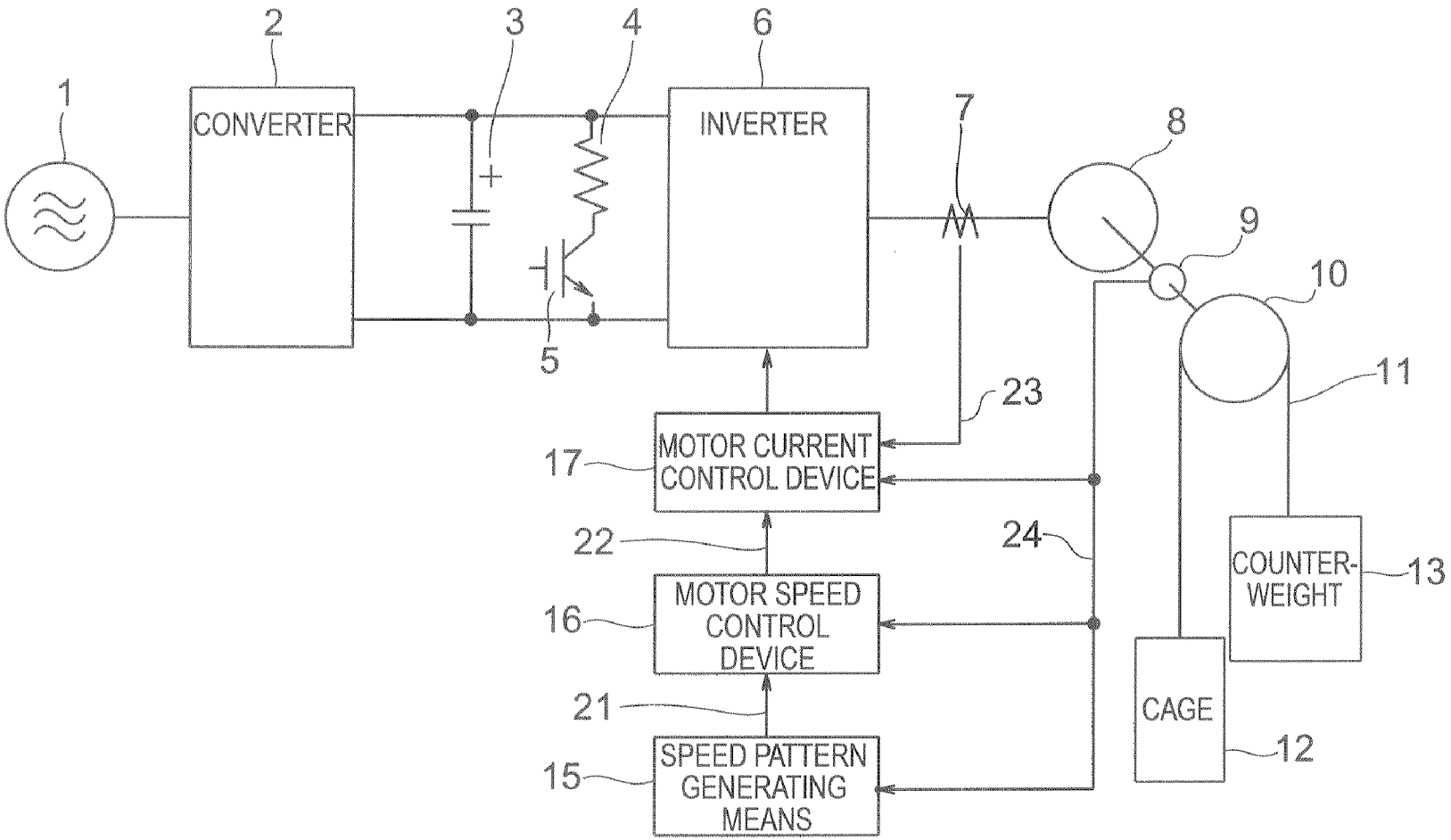
FIG. 8 is a block diagram showing the configuration of an elevator control device according to a fifth embodiment of the present invention.

FIG. 8 is a block diagram showing the configuration of an elevator control device according to a fifth embodiment of the present invention. In the configuration of the fifth embodiment shown in FIG. 3, the same parts as those in the first embodiment shown in FIG. 1 are designated by like symbols, and their description will be omitted. In FIG. 8, in the case where the output of the speed detector 9 is fed back to the speed pattern generating means 15, and a difference between the speed detection value from the speed detector 9 and the speed pattern, or a differential value of the difference exceeds a predetermined threshold value during the acceleration of the cage, the speed pattern generating means 15 changes over the speed pattern to the constant speed travel.

In other words in the elevator control device shown in FIG. 8, the output of the speed detector 9 is fed back, and compared with the speed pattern and controlled by the speed pattern generating means 15. When the motor power, the voltage, and the current are saturated by the power capacity or the motor capacity, the elevator control device operates to increase the difference between the speed pattern and the speed detector 9. Therefore, in the fifth embodiment according to the present invention, the speed pattern generating means 15 operates to stop the acceleration and switch over the speed pattern to the constant speed travel when a difference between the speed pattern and the signal from the speed detector 9 exceeds a threshold value that is set in advance while the cage 12 is being accelerated. As a result, because the rotation speed of the motor 8 is capable of reaching the vicinity of a limit by which the rotation speed of the motor 8 can follow the speed pattern, there is the effect that the cage 12 can be driven at the maximum limit speed of the elevator device.

Alternatively, it is possible that the speed pattern generating means 15 operates to stop the acceleration when the differential value of the difference between the speed pattern and the signal from the speed detector 9 exceeds the threshold value that is set in advance, and change over the speed pattern to the constant speed travel. With the operation, since a change in the rotation speed of the motor 8 and the speed pattern difference can be detected, the speed pattern generating means 15 is capable of operating to change over the speed pattern to the constant speed travel in a shorter period of time, there is advantageous in that the cage can be driven more stably at the maximum limit speed of the elevator device.

Therefore, according to the fifth embodiment, in the case where the difference between the speed detection value from the speed detector 9 and the speed pattern, or the differential value of the difference exceeds the predetermined threshold value during the acceleration of the cage, the speed pattern generating means 15 changes over the speed pattern to the constant speed travel. As a result, there can be provided the elevator drive control that is higher in the speed and stable with the simple configuration within the control device.

Sixth Embodiment

Figure 9:
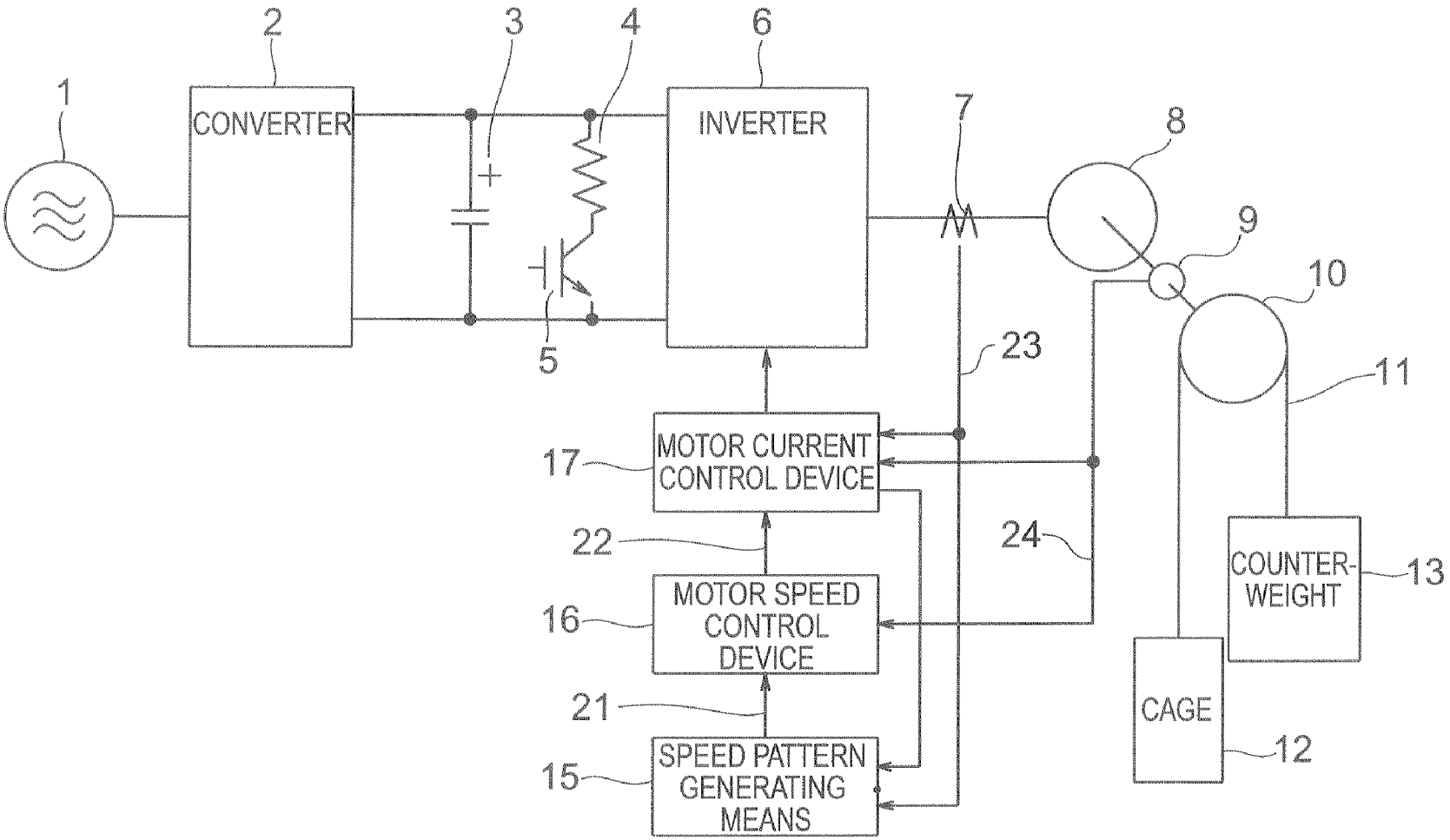
FIG. 9 is a block diagram showing the configuration of an elevator control device according to a sixth embodiment of the present invention.

FIG. 9 is a block diagram showing the configuration of an elevator control device according to a sixth embodiment of the present invention. In the configuration of the sixth embodiment shown in FIG. 9, the same parts as those in the first embodiment shown in FIG. 1 are designated by like symbols, and their description will be omitted. In FIG. 9, the motor current control device 17 outputs a control command to the speed pattern generating means 15 so as to stop the acceleration and change over the speed pattern to the constant speed travel in the case where a difference between the current detection value from the current detector 7 and a current command value, or a differential value of the difference exceeds a predetermined threshold value during the acceleration of the cage. The speed pattern generating means 15 changes over the speed pattern to the constant speed travel on the basis of the control command from the motor current control device 17.

In the elevator control device shown in FIG. 9, because the output of the current detector 7 is fed back, compared with the current command value, and controlled in the motor current control device 17, when the motor power, voltage and current are saturated by the power supply capacity or the motor performance, the motor current control device 17 operates to increase the difference between the current command value and the output of the current detector 7.

Under the above-mentioned circumstances, in the sixth embodiment, the motor control device 17 operates to stop the acceleration and change over the speed pattern to the constant speed travel when a difference between the current command value and a signal from the current detector 7 exceeds a threshold value that is set in advance, or a differential value of the difference between the current command value and the signal from the current detector 7 exceeds a threshold value that is set in advance. In general, because the response speed of the current control system is higher than that of the speed control system, the motor current control device 17 can be operated to change over the speed pattern the constant speed travel with higher precision and at a high speed. As a result, there is advantageous in that the cage can be driven at the maximum limit speed of the elevator device.

Therefore, according to the sixth embodiment, the acceleration stops and the speed pattern changes to the constant speed travel in the case where the difference between the current detection value from the current detector 7 and the current command value, or the differential value of the difference exceeds a threshold value that is set in advance. As a result, there can be provided the elevator drive control that is higher in the speed and stable with the simple configuration within the control device.

The invention claimed is:

1. An elevator control device, which causes a cage to be raised and lowered by a motor driven by an inverter, the cage being connected to one end of a rope having the other end connected to a counterweight through a sheave, the elevator control device comprising:

a current detector for detecting a current that is supplied to the motor from the inverter;

a speed detector for detecting the rotation speed of the motor;

speed pattern generating means for generating an elevator speed pattern;

a motor speed control device for controlling a speed so that a speed detection value from the speed detector follows a speed command value of the speed pattern from the speed pattern generating means; and a motor current control device for controlling a current that is supplied to the motor with respect to the inverter by using a current detection value from the current detector and the speed detection value from the speed detector on the basis of the speed command value from the motor speed control device, wherein the motor current control device has duty detecting means for detecting a duty that is a ratio of an on-time of the inverter within a given sampling period, and wherein the speed pattern generating means changes the speed pattern of the motor on the basis of a duty detection value that is detected by the duty detecting means.

2. The elevator control device according to claim 1, further comprising:

bus voltage detecting means for detecting a bus voltage that is applied to the inverter; and voltage calculating means for calculating a voltage that is applied to the motor on the basis of a bus voltage detection value from the bus voltage detecting means and a duty detection value from the duty detecting means, wherein the speed pattern generating means changes the speed pattern of the motor on the basis of the output of the voltage calculating means.

3. The elevator control device according to claim 1, further comprising target floor setting means for generating a command to move the cage of the elevator from a present floor to a target floor, wherein the speed pattern generating means changes a magnitude of the acceleration of the speed pattern according to a movement distance to the target floor which is set by the target floor setting means.

4. An elevator control device, which causes a cage to be raised and lowered by a motor driven by an inverter the cage being connected to one end of a rope having the other end connected to a counterweight through a sheave, the elevator control device comprising:

a current detector for detecting a current that is supplied to the motor from the inverter;

a speed detector for detecting a rotation speed of the motor;

speed pattern generating means for generating an elevator speed pattern;

a motor speed control device for controlling the speed so that a speed detection value from the speed detector follows a speed command value of the speed pattern from the speed patter generating means;

a motor current control device for controlling a current that is supplied to the motor with respect to the inverter by using a current detection value from the current detector and the speed detection value from the speed detector on the basis of the speed command value from the motor speed control device; and voltage detecting means for calculating a voltage that is applied to the motor on the basis of the current detection value from the current detector and the speed detection value from the speed detector, wherein the speed pattern generating means changes the speed pattern of the motor on the basis of the output of the voltage calculating means.

5. An elevator control device, which causes a cage to be raised and lowered by a motor driven by an inverter, the cage being connected to one end of a rope having the other end connected to a counterweight through a sheave, the elevator control device comprising:

a current detector for detecting a current that is supplied to the motor from the inverter;

a speed detector for detecting a rotation speed of the motor;

speed patter generating means for generating an elevator speed pattern;

a motor speed control device for controlling the speed so that a speed detection value from the speed detector follows a speed command value of the speed pattern from the speed pattern generating means; and a motor current control device for controlling a current that is supplied to the motor with respect to the inverter by using a current detection value from the current detector and the speed detection value from the speed detector on the basis of the speed command value from the motor speed control device, wherein the speed pattern generating means changes over the speed pattern to a constant speed travel in a case where a difference between the speed detection value from the speed detector and a speed pattern or a differential value of the difference exceeds a threshold value that is set in advance during acceleration of the cage.

6. An elevator control device, which causes a cage to be raised and lowered by a motor driven by an inverter the cage being connected to one end of a rope having the other end connected to a counterweight through a sheave, the elevator control device comprising:

a current detector for detecting a cu rent that is supplied to the motor from the inverter;

a speed detector for detecting a rotation speed of the motor;

speed patter generating-means for generating an elevator speed pattern;

a motor speed control device for controlling the speed so that a speed detection value from the speed detector follows a speed command value of the speed pattern from the speed pattern generating means; and a motor current control device for controlling a current that is supplied to the motor with respect to the inverter by using a current detection value from the current detector and the speed detection value from the speed detector on the basis of the speed command value from the motor speed control device, wherein the motor current control means outputs a control command to the speed pattern generating means so as to stop acceleration and change over the speed pattern to a constant speed travel in a case where a difference between the current detection value from the current detector and a current command value or a differential value of the difference exceeds a threshold value that is set in advance during the acceleration of the cage, and wherein the speed pattern generating means changes over the speed pattern to the constant speed travel on the basis of a control command from the motor current control device.

7. The elevator control device according to claim 2, further comprising target floor setting means for generating a command to move the cage of the elevator from a present floor to a target floor, wherein the speed pattern generating means changes a magnitude of the acceleration of the speed pattern according to a movement distance to the target floor which is set by the target floor setting means.

* * * * *